US005117845A

United States Patent [19]

Poulet et al.

[11] Patent Number: 5,117,845

[45] Date of Patent: Jun. 2, 1992

[54] SMOKING MACHINE

[75] Inventors: Jean-Rëmi Poulet, Fleury Les Aubrais; Alain Rousseau; Pierre Debrois, both of Orleans, all of France

[73] Assignee: Societe Nationale d'Exploitation Industrielle des Tabacs et Allumettes, France

[21] Appl. No.: 629,391

[22] Filed: Dec. 18, 1990

[30] Foreign Application Priority Data

Dec. 21, 1989 [FR] France ..... 89 16962

[51] Int. Cl.[5] ..... A24F 13/00

[52] U.S. Cl. ..... 131/330; 131/904; 131/908; 73/865.9; 73/37

[58] Field of Search ..... 131/329, 330, 904, 908; 73/37; 374/8, 45; 318/645

[56] References Cited

U.S. PATENT DOCUMENTS 4,019,366 4/1977 Claflin et al. .
4,333,333 6/1982 Pangritz ..... 374/8
4,365,640 12/1982 Lorenz et al. .
4,400,972 8/1983 Wiethaup ..... 374/8 X
4,836,223 6/1989 Burghart et al. ..... 131/329
4,858,628 8/1989 Norman et al. ..... 131/329

FOREIGN PATENT DOCUMENTS 0040928 2/1981 European Pat. Off. .
2470380 5/1981 France .

OTHER PUBLICATIONS

C. Decker et al. Mitteilungen Aus Dem Gebiete Der Lebensmitteluntersuchung Und Hygiene, vol. 46, fasc. 2, 1955, pp. 178-182.

*Primary Examiner*—V. Millin
*Assistant Examiner*—J. Doyle
*Attorney, Agent, or Firm*—Rosenman & Colin

[57] ABSTRACT

A smoking machine includes, for controlling the conditions in which each article to be smoked is smoked, only a servo-control device for controlling, to a reference value, the pressure difference between the suction end and the rest of the body of the cigarette. The support of each article is mounted for rotating so as to allow, for example, more accurate detection of the position of the incandescent zone by optical sensors and a processing circuit.

12 Claims, 3 Drawing Sheets

SMOKING MACHINE

BACKGROUND OF THE INVENTION

1. Field of the Invention

The present invention relates to a machine for smoking at least one cigarette or similar article under given conditions for analyzing the way in which said cigarette is smoked.

Such a machine is used in the tobacco industry for smoking cigarettes, cigarillos or cigars, for determining certain parameters characterizing the quality of the article to be smoked.

There exist two ways of smoking a cigarette for the tester, the first in which the cigarette is consumed freely and the second in which it is subjected to sucking in. The machine of which it is a question here smokes a cigarette according to the second.

2. Description of the Prior Art

Machines of this type are already known which use a suction piston which draws in, in one or more puffs, a constant volume of smoke laden air so as to determine the nicotine and tar content.

In such a machine, the exact flowrate and pressure conditions to which the cigarette is subjected are not known, which makes subsequent comparisons between different cigarettes difficult, other than those relative to the nicotine and tar content. In addition such machines are relatively slow because of their discontinuous operation.

A machine of the above defined type is already known from the U.S. Pat. No. 4,019,366. This machine smokes several cigarettes simultaneously, subjecting each cigarette to a succession of puffs at a given rate. For this, it is provided with adjustment members, for adjusting separately for each of the cigarettes, the air flow which passes through it at each puff, as well as the duration of this puff and the time interval between two successive puffs. In this apparatus, relatively long and complex to use, account is not taken of the variations of behavior of each cigarette during its combustion, which variations may affect the value of the flowrate and cause it to deviate from the a priori adjusted value. In addition, in this apparatus, controlling the conditions to which the cigarettes are subjected uses a flow measurement device, or flowmeter, which is likely to clog up because it comprises very fine calibrated ducts through which the smoke laden air passes.

Furthermore, it is proposed in the French application 89 19432 to use the apparatus for measuring the flowrate-pressure characteristics which it describes for maintaining the flowrate permanently equal to a reference value. This apparatus, which uses a valve controlled by an electronic circuit in response to the instantaneous value of the flowrate, measured by a flowmeter, partially overcomes the preceding drawbacks, but the problem related to clogging up of the flowmeter still exists. In addition, a transformation of the apparatus into a "multi-channel" type apparatus, i.e. allowing several cigarettes to be tested simultaneously, means that as many flowmeters, controllable valves and valve control circuits must be provided as there are channels, which makes the apparatus relatively costly and bulky.

SUMMARY OF THE INVENTION

The purpose of the present invention is to overcome the preceding drawbacks by providing in particular a simple smoking machine allowing tests to be carried out under known repetitive conditions from one cigarette to another, insensitive to clogging up and of a relatively low cost and size in a multi-channel version.

For this, it provides a smoking machine of the above defined type, characterized by the fact that the only means which it comprises for controlling said given conditions are servo-control means for controlling, to a reference value, the pressure difference between the suction end and the rest of the body of the cigarette.

In the machine of the invention, the value of the pressure difference to which the cigarette is subjected is independent of the particular qualities of such a cigarette, which makes good reproducibility of the test possible. In addition, the servo-control means require only a pressure sensor in contact with the smoke. Now, a pressure sensor is insensitive to clogging up. Moreover, the machine of the invention allows the cigarette to be smoked more rapidly than known apparatus operating by successive puffs.

In its preferred embodiment, the machine of the invention is provided for smoking a plurality of cigarettes, all the suction ends of the cigarettes are subjected to the same pressure, all the bodies of the cigarettes are subjected to the atmospheric pressure and said servo-control means control the difference between the pressure common to the suction ends and the atmospheric pressure.

Thus, a very simple multi-channel apparatus is obtained of a relatively low cost price, which ensures identical pressure conditions for each of the cigarettes smoked.

Advantageously, optical means are provided for detecting the incandescent zone of each cigarette, each cigarette and the associated optical means are driven, with respect to each other, with a rotational movement about the axis of the cigarette, and means are provided for statistically processing the output signal from said optical means, for determining the position of the incandescent zone.

BRIEF DESCRIPTION OF THE DRAWINGS

The present invention will be better understood from the following description of the preferred embodiment of the smoking machine of the invention, with reference to the accompanying drawings, in which.

DESCRIPTION OF THE PREFERRED EMBODIMENT

The smoking machine described hereafter is here intended to smoke a plurality of cigarettes, for determining the rate of combustion of each of them. It could however be adapted for smoking cigars and, generally, any smoking article, for determining any parameter characterizing the way in which such an article behaves when it is smoked.

Figure 1:
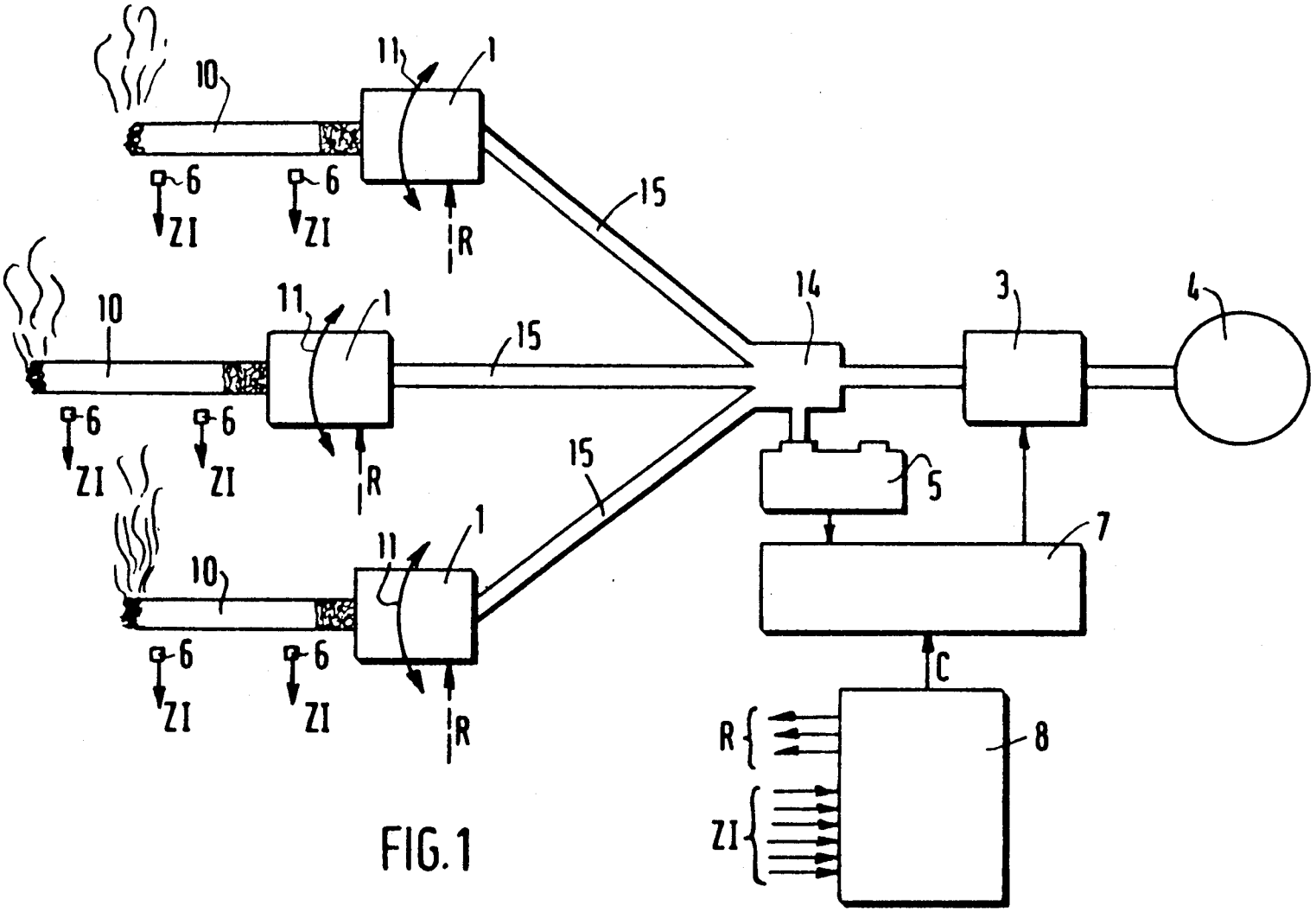
FIG. 1 shows schematically a smoking machine according to the invention.

Here, referring to FIG. 1, the machine comprises three identical sample-holders 1, each supporting a cigarette 10, or sample.

Each of the sample-holders 1 is adapted, in a way which will be more fully described hereafter, so that the suction end of each cigarette 10 is subjected to a lower pressure than the atmospheric pressure to which the rest of the body of the cigarette is subjected. The suction end of each cigarette 10 is that through which the smoker draws the smoke.

To subject the suction end of each cigarette 10 to a pressure lower than the atmospheric pressure, each sample-holder is placed in communication, through a duct 15, with a cavity 14 connected to a vacuum pump 4 via a controllable valve 3 with continuous control.

Each of ducts 15 has a sufficient diameter so that all the suction ends are subjected to the pressure which prevails in cavity 14. Here, in addition, the ducts 15 are of equal lengths.

The pressure sensor 5, here differential, permanently measures the difference between the pressure in cavity 14 and the atmospheric pressure.

Optical sensors 6, for example infrared photodiodes 6, are disposed along the body of each cigarette 10 for detecting the passage of the incandescent zone of this cigarette 10 when it is smoked. Here, only two sensors per cigarette 10 are provided, each disposed close to an end of the cigarette, but there could be several. Each sensor delivers a signal ZI.

Each sample-holder 1 is driven with a rotational movement such that each cigarette rotates about its axis, in one direction then in the other, as shown by arrow 11. The direction, speed and duration of each revolution are controlled by a signal R.

A servo-control electronic circuit 7 controls valve 3 in response to a reference signal C and to the output signal of the pressure sensor 5, so that the pressure inside cavity 14 remains at all times equal to the reference value C.

An electronic circuit 8, comprising in particular a microprocessor, delivers the reference signal C, and the rotation control signals R and receives the signals ZI output by the optical sensors 6.

Before describing the sample-holders 1 and circuit 7 in greater detail, the operation of the smoking machine will now be described.

The microprocessor circuit 8 delivers the reference signal of a given value, corresponding to the pressure difference under which each cigarette 10 is to be smoked, for example 1KPa. In a way known per se circuit 7 determines the difference between the value measured by the pressure sensor 5 and the reference value, and controls valve 3 so as to maintain this difference at a practically zero value.

All the suction ends of the cigarettes 10 are therefore subjected to the pressure which prevails in cavity 14, practically equal to the reference pressure. Since, moreover, the rest of the body of the cigarettes 10 is subjected to the atmospheric pressure, each of the cigarettes 10 is subjected to the same pressure difference.

The cigarettes are then lit, by hand or with an automatic device of known type and not shown for the sake of simplicity.

When the incandescent zone of the cigarette 10 passes in front of the optical sensors 6, the value of the output signal of this sensor increases substantially, which allows the microprocessor of circuit 8 to determine and store the time when the incandescent zone passes in front of this sensor, so as to determine subsequently the speed at which the cigarette is consumed when it is subjected to a pressure difference equal to the reference value.

Here, the rotation of each cigarette 10 about its axis increases the accuracy with which the passage times in front of the optical sensors 6 are determined. For this, the microprocessor circuit 8 processes the output signal of each sensor 6 statistically so as to take into account possible dissymmetry of the incandescent zone.

Figure 2:
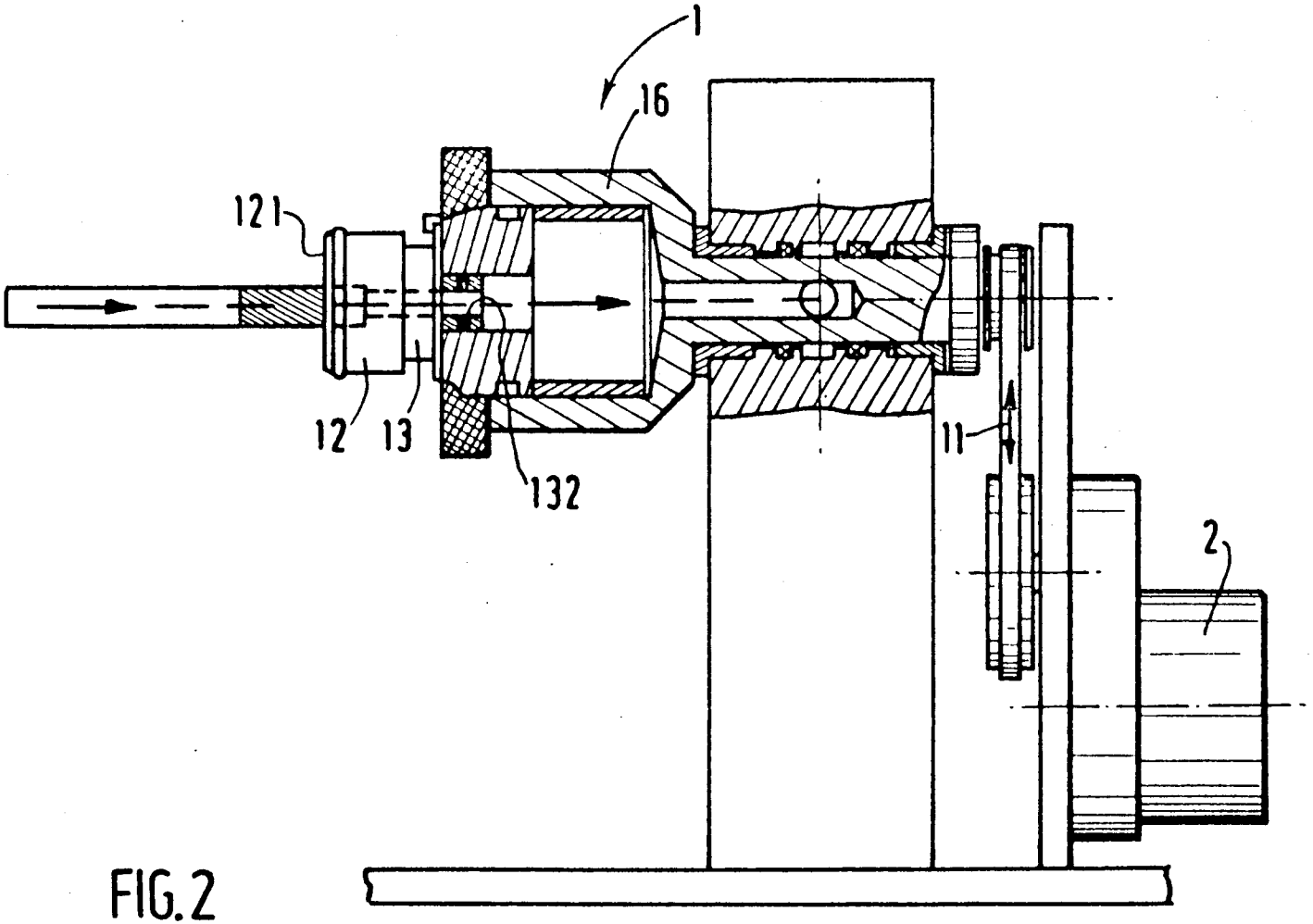
FIG. 2 shows in greater detail a sample-holder of the machine of FIG. 1.
Figure 3A:
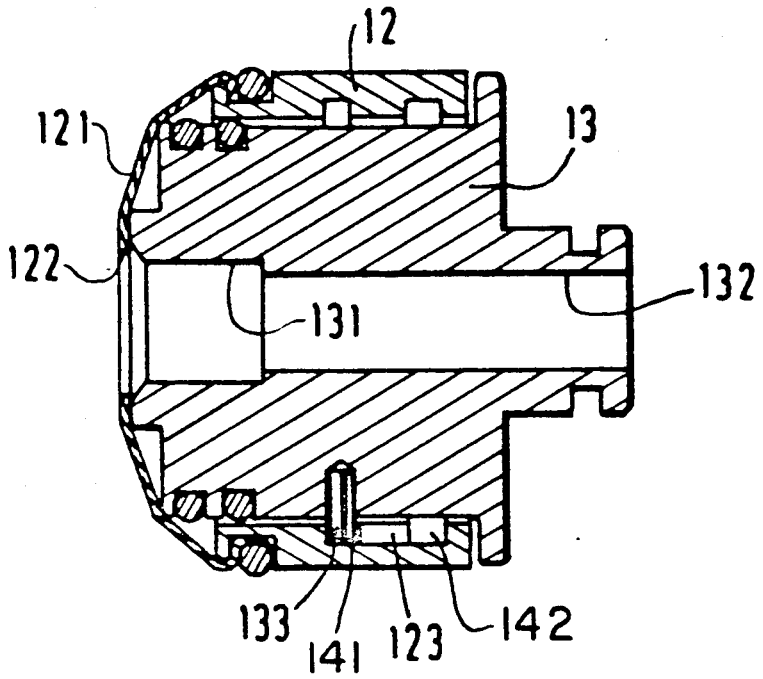
FIGS. 3*a* and 3*b* show a sectional view of the part of the sample-holder of FIG. 2 which receives a cigarette, in the working position and rest position respectively.
Figure 3B:
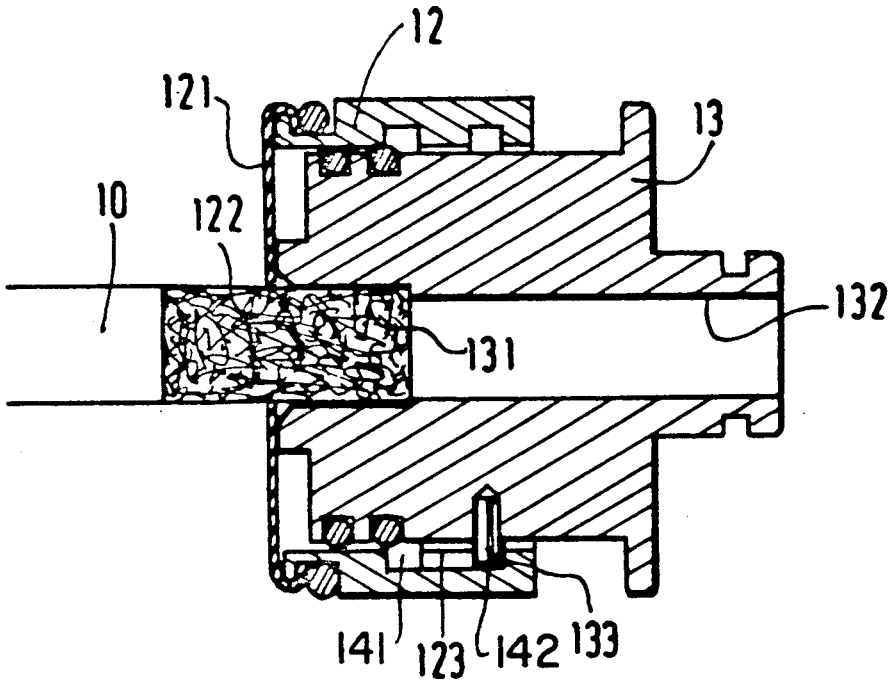

As shown in FIGS. 2, 3*a* and 3*b* each sample-holder 1 comprises a ring 12, on which is stretched an elastic membrane 121, here made from latex, pierced with an orifice 122 of a diameter less than that of a cigarette. In the working position, cigarette 10 passes through orifice 122 and membrane 121 acts as a sphincter for sealingly separating the suction end from the rest of the body of the cigarette, and thus it is subjected to the reduced pressure which prevails in the inner volume of cavity 14.

To make positioning and removal of cigarette 10 easy, ring 12 is mounted for sliding on a cylindrical piece 13 having a bore 131 intended to receive the suction end of cigarette 10, which bore communicates through another bore 132 of smaller diameter with duct 15. The sealing between ring 12 and piece 13 is provided by 0 seals disposed in annular grooves of piece 13.

For positioning a cigarette 10, ring 12 is slid along the cylindrical piece 13 so that the end of the latter projects with respect to ring 12, causing a deformation of membrane 121 which enlarges orifice 122, as shown in FIG. 3*a*. This makes it easy to position the cigarette 10 whose suction end is engaged in bore 131.

When the cigarette is engaged in bore 131, in abutment against a shoulder formed with bore 132, ring 12 is slid in the opposite direction to the preceding direction so that membrane 121 may again assume its flat form extending vertically, in which orifice 121 is closed on the body of cigarette 10, as shown in FIG. 3*b*. A finger 133, fast with ring 12, cooperates with two circular grooves 141 and 142 and a longitudinal groove 123 formed in the internal wall of ring 12 for immobilizing ring 12 in one of the positions shown in FIGS. 3*a* and 3*b*, or sliding thereof between these two positions. For removing the cigarette, the procedure is the opposite.

The cylindrical piece 13 is fast with an assembly 16 driven in rotation by motor 2, in one direction or in the other as shown by arrow 11, bore 132 being in communication with duct 15 via a rotary seal of known type.

The servo-control circuit is of known type which comprises a subtracter followed by an amplification chain comprising a proportional response amplifier, an integral response amplifier and a derived response amplifier, these three amplifiers being mounted in parallel. The amplification chain is followed by a power amplifier which controls valve 3. Such a circuit, as is known, provides a good speed-accuracy-stability compromise for the pressure control.

Naturally, the present invention is not limited to the embodiment which has just been described. Thus, in particular, the machine could comprise only one or two or even more than three sample-holders.

Similarly, the value of the reference signal C is not necessarily constant and may vary in time in accordance with a predetermined law.

Finally, to benefit from the accuracy of the measurement of the position of the incandescent zone, it would also be possible to leave each cigarette 10 immobile while causing each optical sensor 6 to rotate about the axis of the cigarette.

What is claimed is:

1. A machine for smoking at least one smoking article having smoking parameters to be analyzed, comprising:

(a) holder means for holding a suction end of said one smoking article, while leaving exposed to atmospheric pressure an opposite end to be lit during smoking;

(b) a chamber having an inlet in fluid flow communication with the holder means, an outlet, and a flow-through passage between the inlet and the outlet;

(c) suction means in fluid flow communication with the outlet, for drawing smoke under pressure in a flow from the lit end through the suction end of said one smoking article, and into and through the flow-through passage of the chamber;

(d) pressure sensor means in fluid flow communication with the flow-through passage, for measuring a pressure differential between the pressure in the flow-through passage and the atmospheric pressure, and for generating a measured electrical signal indicative of the measured pressure differential;

(e) reference means for generating a reference electrical signal indicative of a desired pressure differential between the suction and lit ends of said one smoking article; and (f) flow control means operatively connected to the reference means and the suction means in a feedback loop with the pressure sensor means, for comparing the measured and reference electrical signals to generate an error signal, and for changing the flow of smoke through the flow-through passage as a function of the error signal.

2. The machine according to claim 1, wherein the holder means includes a support having a bore for receiving the suction end of said one smoking article, a ring mounted for sliding movement on the support, and an elastic membrane having an aperture concentric with the bore and mounted on the ring for joint movement therewith between open and closed positions in which the aperture freely receives, and seals, respectively, the suction end of said one smoking article.

3. The machine according to claim 2, wherein the support has a projection, and wherein the ring has two grooves in which the projection is respectively received in each of said positions.

4. The machine according to claim 1; and further comprising drive means for rotating the holder means and said one smoking article about a longitudinal axis thereof.

5. The machine according to claim 4, wherein the drive means includes a reversible motor for jointly rotating the holder means and said one smoking article in alternate succession in opposite circumferential directions about the longitudinal axis.

6. The machine according to claim 1, wherein there are multiple holder means for respectively holding multiple smoking articles; and wherein the chamber has multiple inlets in respective fluid flow communication with the multiple holder means; and wherein the suction means, pressure sensor means, reference means and flow control means are common to all of the smoking articles.

7. The machine according to claim 1, wherein the suction means includes a vacuum pump and an electrically operable flow valve.

8. The machine according to claim 1, wherein the pressure sensor means has one pressure port open to atmospheric pressure, and another pressure port in fluid flow communication with the flow-through passage.

9. The machine according to claim 1, wherein the flow control means is a servo control circuit.

10. The machine according to claim 1 and further comprising optical sensing means in the circumambient region of said one smoking article, for detecting the location of the lit end during smoking.

11. The machine according to claim 10, wherein the optical sensing means includes a plurality of optical sensors spaced apart of one another along a longitudinal axis of said one smoking article.

12. The machine according to claim 10; and further comprising means for causing relative rotating movement between the holder means and the optical sensing means.

* * * * *